United States Patent [19]

Kasai

[11] Patent Number: 4,520,533

[45] Date of Patent: Jun. 4, 1985

[54] STRAP GUIDE FOR STRAP ADJUSTMENT ASSEMBLY

[75] Inventor: Kazumi Kasai, Namerikawa, Japan

[73] Assignee: Nippon Notion Kogyo Co., Ltd., Tokyo, Japan

[21] Appl. No.: 522,401

[22] Filed: Aug. 11, 1983

[30] Foreign Application Priority Data

Aug. 12, 1982 [JP] Japan ..... 57-122728[U]

[51] Int. Cl.[3] ..... A44B 11/00

[52] U.S. Cl. ..... 24/198; 24/200; 24/265 BC; 2/305

[58] Field of Search .... 24/265 BC, 265 EC, 265 AL, 24/265 CD, 315, 321, 570, 143 B, 169, 196, 197, 198, 199, 200, 266, 588; 2/305, 311, 325

[56] References Cited

U.S. PATENT DOCUMENTS

| | | | |
|---|---|---|---|
| 244,776 | 7/1881 | Wales | 24/315 |
| 426,523 | 4/1890 | Carpenter | 24/198 |
| 975,942 | 11/1910 | Flynn | 24/198 |
| 1,687,370 | 10/1928 | La Vigne | 24/265 AL |
| 1,999,167 | 4/1935 | White | 24/200 |
| 2,187,349 | 1/1940 | Keys | 24/265 AL |
| 2,208,026 | 7/1940 | Goldenberg | 2/325 |
| 2,269,696 | 1/1942 | Shaulson | 24/200 |
| 2,473,209 | 6/1949 | Lombardt | 24/200 |
| 3,112,750 | 12/1963 | Jonas | 24/200 |
| 3,720,434 | 3/1973 | Archer | 24/265 EC |

FOREIGN PATENT DOCUMENTS

| | | | |
|---|---|---|---|
| 769541 | 8/1934 | France | 24/570 |
| 965771 | 9/1950 | France | 24/265 AL |

*Primary Examiner*—Victor N. Sakran

*Attorney, Agent, or Firm*—Hill, Van Santen, Steadman & Simpson

[57] ABSTRACT

A strap guide is made of synthetic resin and comprises a wing integral with a hollow rectangular frame or strap body, the wing having a plurality of needle-penetratable portions spaced from one another at equal intervals for the passage therethrough of a sewing needle. The wing includes a plurality of parallel spaced ribs and the needle-penetratable portions are defined between two adjacent ones of the ribs. Each rib has a pair of sidewalls converging toward each other for guiding the sewing needle into an adjacent one of the needle-penetratable portions when the needle is thrust in.

11 Claims, 10 Drawing Figures

STRAP GUIDE FOR STRAP ADJUSTMENT ASSEMBLY

BACKGROUND OF THE INVENTION

1. Field of the Invention

The present invention relates generally to a strap adjustment assembly for adjustably interconnecting the edges of a garment, bag, cap or the like by means of a strap or belt, and more particularly to a strap guide for use in such a strap adjustment assembly.

2. Prior Art

Various strap adjustment assemblies have been used for adjustably joining the edges or parts of an article such as a garment, cap, bag or the like. Such known strap adjustment assemblies generally comprise a strap guide of hollow rectangular shape mounted on one of the edges of the article and guiding around its one bar an end portion of a first strap which is secured at another end to the other edge of the article. For mounting, the rectangular strap guide is attached to one end of a second strap by looping the end around another bar of the guide and sewn to itself, and then the second strap is sewn to the one edge of the article. The known strap guide thus arranged is difficult to attach by sewing to the article.

SUMMARY OF THE INVENTION

It is an object of the present invention to provide a strap guide for strap adjustment assemblies which can be attached by sewing to an article with utmost ease.

Another object of the present invention is to provide a strap guide having means attachable by being sewn directly to an article.

A further object of the present invention is to provide a strap guide which is inexpensive to manufacture and can be colored as desired to meet the user's various color preferences.

According to the invention, a strap guide is made of synthetic resin and comprises a wing integral with a hollow rectangular frame or strap body, the wing having a plurality of needle-penetratable portions spaced from one another at equal intervals for the passage therethrough of a sewing needle. The wing includes a plurality of parallel spaced ribs and the needle-penetratable portions are defined between two adjacent ones of the ribs. Each rib has a pair of sidewalls converging toward each other for guiding the sewing needle into an adjacent one of the needle-penetratable portions when the needle is thrust in. The needle-penetratable portions include needle-penetratable films of synthetic resin contiguous to two adjacent ones of the ribs.

Many other advantages, features and additional objects of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
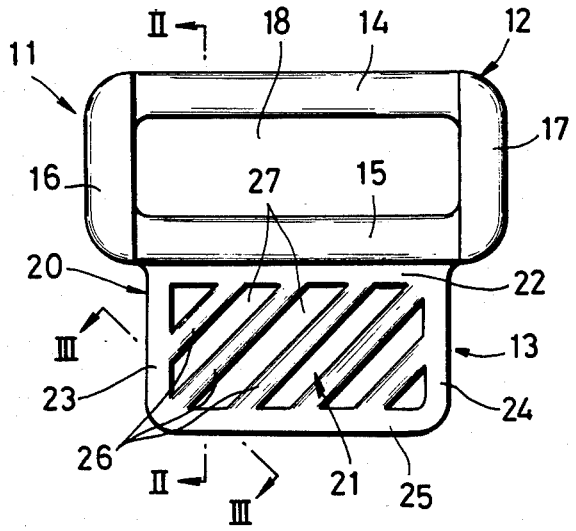
FIG. 1 is a plan view of a strap guide according to the present invention.
Figure 2:
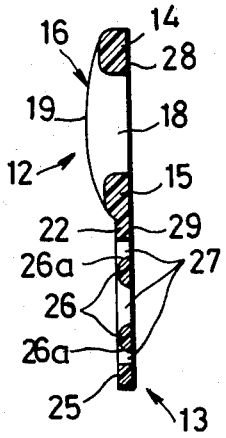
FIG. 2 is a cross-sectional view taken along line II—II of FIG. 1.
Figure 3:
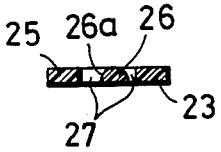
FIG. 3 is a cross-sectional view taken along line III—III of FIG. 1.

The principles of the present invention are particularly useful when embodied in a strap guide such as shown in FIGS. 1 to 3, generally indicated by the numeral 11. The strap guide 11 is molded of synthetic resin and comprises a hollow frame 12 of a substantially rectangular shape and a rectangular wing 13 integral with the the frame 12.

The frame 12 has a pair of parallel spaced guide and support bars 14, 15 and a pair of parallel spaced connecting rods 15, 17 interconnecting the bars 14, 16, the bars 14, 15 being longer than the rods 16, 17. The bars 14, 15 and the rods 16, 17 jointly define therebetween a rectangular opening 18 for the passage therethrough of a belt or strap. The belt is turned over to form a loop around the guide 14 as described below. As shown in FIG. 2, the rods 16, 17 are thicker than the bars 14, 15 and have respective front surfaces 19 extending arcuately between the bars 14, 15.

The wing 13 has a substantially hollow rectangular peripheral portion 20 and a central web portion 21 surrounded by the peripheral portion 20. The peripheral portion 20 includes a base 22 joined with the support bar 15, a pair of parallel spaced legs 23, 24 respectively joined at one end with the opposite ends of the base 22 and extending away from the support bar 15, and a connecting rod 25 interconnecting the other ends of the legs 23, 24. The central web portion 21 includes a plurality of parallel spaced ribs 26 extending obliquely across the web portion 21 and a plurality of slots 27 extending between two adjacent ones of the ribs 26, the slots 27 constituting needle-penetratable portions as described below. As shown in FIG. 2, the wing 13 is thinner than the bars 14, 15 of the frame 12, and both the frame 12 and the wing 13 have respective rear surfaces 28, 29 lying flush with each other. The ribs 26 have a semi-circular transverse cross section and hence have a pair of arcuate sidewalls **26*a* converging toward the front side of the wing 13, as shown in FIGS. 2 and 3**.

Figure 5:
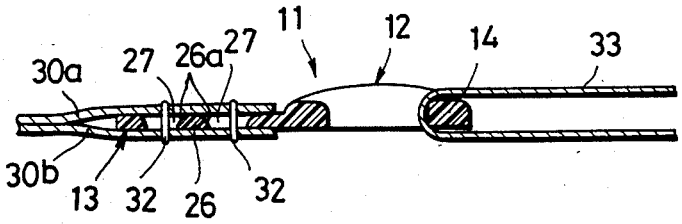
FIG. 5, appearing on sheet 1, is an enlarged horizontal cross-sectional view taken along line V—V of FIG. 4.
Figure 4:
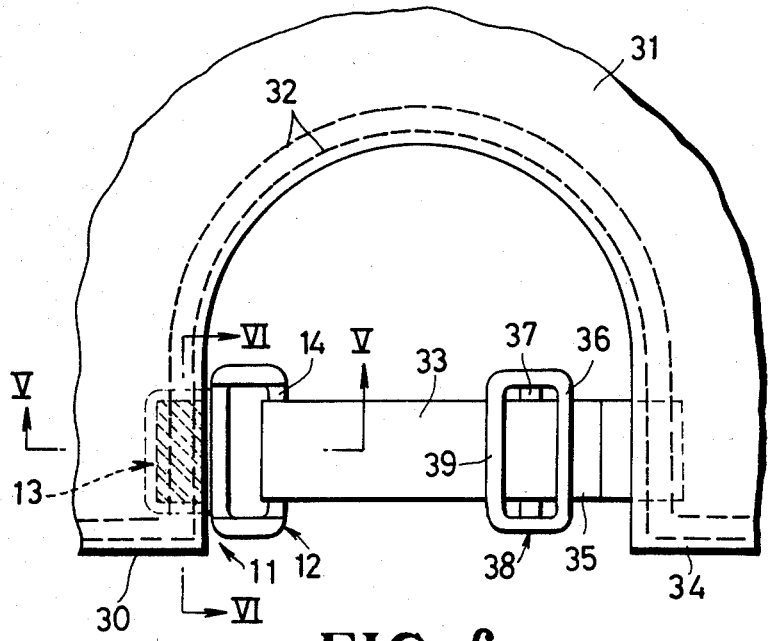
FIG. 4 is a fragmentary rear elevational view of a cap on which is mounted a strap adjustment assembly including the strap guide shown in FIG. 1.
Figure 6:
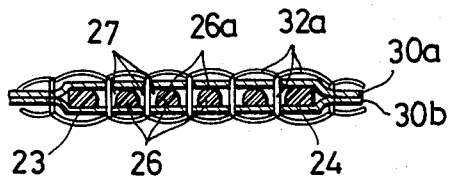
FIG. 6 is an enlarged vertical cross-sectional view taken along line VI—VI of FIG. 4.

The strap guide 11 is attached to a first edge or cloth part 30 of a cap 31 as shown in FIGS. 4 to 6. The wing 13 is placed between a pair of front and rear cloth layers **30*a*, 30*b* (FIGS. 5 and 6) of the cap 31 with the front surface of the guide 11 facing upwardly. Then, the wing 13 is secured by a pair of rows of stitches 32 to the first cloth part 30 of the cap 31. During sewing, a pair of sewing needles (not shown) penetrate the front and rear cloth layers 30*a*, 30*b* successively through the slots or grooves 27 so that each stitch or loop 32*a* encircles one of the ribs 26 as shown in FIG. 6**.

Since the ribs 26 have the arcuate sidewalls **26*a*, each of the sewing needles while being driven is guided by one of the arcuate sidewalls 26*a* into an adjacent one of the grooves 27, even when the needle and the groove 27 are not in registry with each other. Further, as each row of stitches passes across the wing 13 at an angle to the ribs 26, the strap guide 11** is held in position against displacement, even when lateral forces are applied threto.

As shown in FIG. 4, a belt or strap 33 is sewn at its one end portion to a second edge or cloth part 34 of the cap 31. The opposite strap end portion 35 is threaded between an outer bar 36 and a central bar 37 from the back to the face of a strap retainer 38, and then between the central bar 37 and another outer bar 39 from the face or front to the back of the retainer 38. The strap end portion 35 is turned over to form a loop around the guide bar 14 of the frame 12 and again threaded between the bars 39, 37, 36 in a reversed sequence. The strap retainer 38 and the strap guide 11 jointly constitute a strap adjustment assembly.

Figure 7:
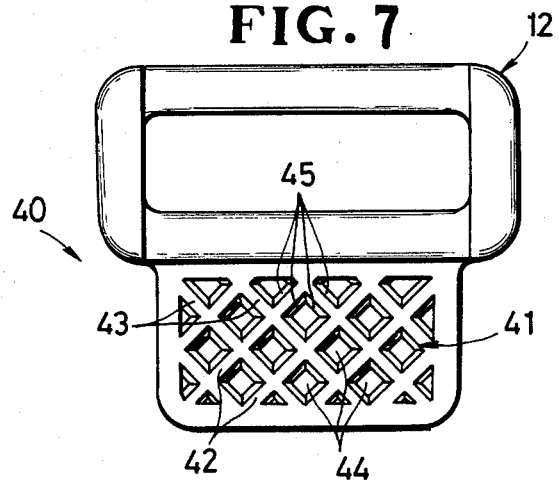
FIG. 7 is a plan view of a modified strap guide.

A modified strap guide 40 shown in FIG. 7 is structurally the same as the guide 11 described above with the exception that a central web portion 41 includes a plurality of first ribs 42 extending obliquely across the web portion 41 and a plurality of second ribs 43 extending normal to the first ribs 42 across the web portion 41. The first and second ribs 41, 42 extend in a diagonal pattern so as to define a plurality of substantially square apertures 44 between two adjacent ones of the first ribs 42 and two adjacent ones of the second ribs 43. The apertures 44 constitute needle-penetratable portions for the passage therethrough of sewing needles (not shown). Each of the ribs 42, 43 has a truncated triangle or trapezoidal shape in transverse cross section having pairs of sidewalls 45 diverging rearwardly of the web portion 41. The sidewalls 45 serve in the same manner as the arcuate sidewalls 26*a* of the ribs 26. The ribs 42, 43 may have a triangular cross section of which a corner is directed upwardly (not shown). It is essential that the ribs have a pair of side walls converging toward the front side of the wing from which a sewing needle is thrust in.

Figure 8:
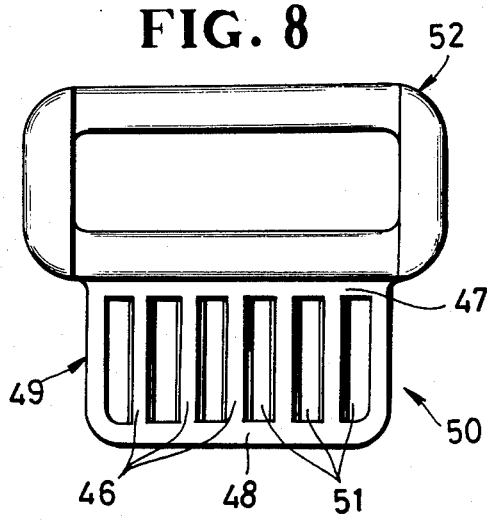
FIG. 8 is a view similar to FIG. 7, showing another modification.

FIG. 8 shows another modification in which a plurality of parallel spaced ribs 46 extends perpendicularly between a base 47 and a connecting bar 48 of a peripheral portion 49 of a wing 50 so as to define therebetween a plurality of slots 51 for the passage therethrough of sewing needles (not shown). The base 47, joined with a frame 52, and the connecting bar 48 prevent stitches (not shown) from displacing off the ribs 46.

Figure 9:
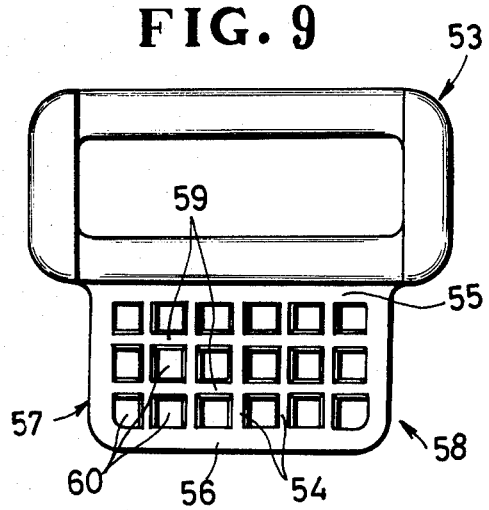
FIG. 9 is a plan view of a modified strap guide.

Another modified strap guide 53 shown in FIG. 9 includes a plurality of first ribs 54 extending perpendicularly between a base 55 and a connecting bar 56 of a peripheral portion 57 of a wing 58 and a plurality of second ribs 59 extending perpendicularly to the first ribs 54. The ribs 54, 59 extend checkerwise in the wing 58 so as to define, between two adjacent ones of the first ribs 54 and two adjacent ones of the second ribs 59, a plurality of substantially square apertures 60 for the passage therethrough of sewing needles (not shown).

Figure 10:
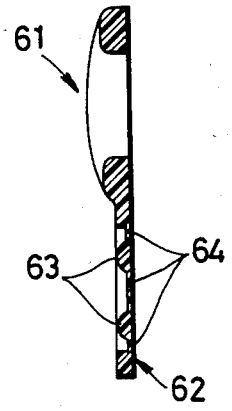
FIG. 10 is a view similar to FIG. 2, showing a modified strap guide.

FIG. 10 shows a further modification in which a strap guide 61 includes a wing portion 62 having a plurality of parallel spaced ribs 63 and a plurality of needle penetratable portions 64 extending between two adjacent ones of the ribs 63. Each of the needle-penetratable portions 64 is formed of a film of synthetic resin, the film 64 being of a thickness such that it is readily penetratable by a sewing needle when the latter is thrust in.

The strap guides constructed in accordance with the invention have many advantages: With the wing having a plurality of needle-penetratable portions spaced at equal intervals, the strap guide can be attached with utmost ease by sewing it directly to one of the edges of an article to be adjustably interconnected. The sewing needle is introduced into the needle-penetratable portions by the guide surface on each rib adjacent to one of the needle-penetratable portions even when the needle and the needle-penetratable portion are not in registry with each other. Since the strap guide is made of synthetic resin, it can be injection-molded in large quantities and hence inexpensively, and can be colored as desired to meet the user's various color preferences in vogue.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A one-piece molded strap guide for use in a strap-adjustment assembly, comprising:

(a) a rectangular frame having a single central strap-receiving rectangular opening therein; and (b) a rectangular attachment wing integral with one side of said frame remote from said opening, and having a length corresponding to that of said opening, said rectangular wing having a pattern of uniformly spaced parallel openings defined by a series of uniformly spaced ribs, said spaced openings being receptive of sewing stitches by which said wing may be sewn to the assembly.

2. A strap guide according to claim 1, said wing having a base joined with one side of said frame and extending parallel with the same, and each of said ribs being joined at one end with said base and extending obliquely away from said frame.

3. A strap guide according to claim 2, said ribs extending in a diagonal pattern in said wing.

4. A strap guide according to claim 2, said ribs extending checkerwise in said wing.

5. A strap guide according to claim 1, said wing having a base joined with one side of said frame and extending parallel with the same, each of said ribs being joined at one end with said base and extending perpendicularly away from said frame, and said ribs being interconnected by a connecting rod at the respective opposite ends.

6. A strap guide according to claim 1, each of said ribs having a pair of sidewalls converging toward each other.

7. A strap guide according to claim 1, each of said ribs having a semi-circular transverse cross section.

8. A strap guide according to claim 1, each of said ribs having a trapezoidal transverse cross section.

9. A strap guide according to claim 1, each of said wing opening comprising a substantially square opening.

10. A strap guide according to claim 1, each of said wing opening comprising a needle-penetratable film of synthetic resin contiguous to two adjacent ones of said ribs.

11. A strap guide of synthetic resin for a strap adjustment assembly for adjustably interconnecting a pair of opposed edges of an article, said strap guide comprising:

(a) a hollow rectangular frame having an opening therein; and (b) a wing adapted to be connected by sewing to one of the opposite edges, being integral with said frame and extending laterally away from said opening, said wing having a plurality of needle-penetratable portions spaced from one another at equal intervals for the passage therethrough of a sewing needle, said wing having a plurality of parallel spaced ribs, each of said needle-penetratable portions being defined between two adjacent ones of said ribs, each of said ribs having a pair of sidewalls converging toward the front side of said wing for guiding the needle into an adjacent one of said needle penetratable portions when the needle is thrusted from said front side.

* * * * *